US006326921B1

(12) United States Patent
Egorov et al.

(10) Patent No.: US 6,326,921 B1
(45) Date of Patent: Dec. 4, 2001

(54) LOW PROFILE BUILT-IN MULTI-BAND ANTENNA

(75) Inventors: Igor Egorov; Zhinong Ying, both of Lund (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 09/525,228

(22) Filed: Mar. 14, 2000

(51) Int. Cl.[7] ..... H01Q 1/38; H01Q 1/24
(52) U.S. Cl. ..... 343/700 MS; 343/702
(58) Field of Search ..... 343/702, 700 MS, 343/895, 828, 846, 872, 866, 870, 741, 867, 813

(56) References Cited

U.S. PATENT DOCUMENTS

| | | | | |
|---|---|---|---|---|
| 5,365,246 | | 11/1994 | Rasinger et al. . | |
| 5,550,554 | * | 8/1996 | Erkocevic | 343/828 |
| 5,784,032 | * | 7/1998 | Johnston | 343/702 |
| 5,914,690 | * | 6/1999 | Lehtola et al. | 343/702 |
| 6,002,367 | * | 12/1999 | Engblom et al. | 343/700 MS |
| 6,157,348 | * | 12/2000 | Openlader | 343/846 |
| 6,184,836 | * | 2/2001 | Ali | 343/702 |
| 6,211,841 | * | 4/2001 | Smith et al. | 343/813 |

FOREIGN PATENT DOCUMENTS

| | | |
|---|---|---|
| 0 715 488 A1 | 6/1996 | (EP) . |
| 09260934 | 3/1997 | (EP) . |
| A-6-37531 | 2/1994 | (JP) . |
| WO 96/27219 | 9/1996 | (WO) . |
| WO 98/44587 | 10/1998 | (WO) . |
| WO 99/43043 | 8/1999 | (WO) . |

OTHER PUBLICATIONS

Kathleen Virga et al., Low–Profile Enhanced–Bandwidth PIFA Antennas for Wireless Communications Packaging; *IEEE Transactions on Microwave Theory and Techniques*, vol. 45, No. 10; Oct. 1997.

K. Qassim, Antenna Products Ltd., Inverted–F Antenna for Portable Handsets (XP 000567386); The Institution of Electrical Engineers, 1994.

European Standard Search Report Date of Completion: Sep. 12, 2000; Date of Mailing: Sep. 18, 2000.

* cited by examiner

*Primary Examiner*—Don Wong
*Assistant Examiner*—Chuc D Tran
(74) *Attorney, Agent, or Firm*—Burns, Doane, Swecker & Mathis, L.L.P.

(57) ABSTRACT

A built-in, low-profile antenna having an inverted planar inverted F-type (PIFA) antenna and a meandering parasitic element having a wide bandwidth to facilitate communications within a plurality of frequency bands is disclosed. The main element is placed at a predetermined height above a substrate of a communication device and the parasitic element is placed on the same substrate as the main antenna element and is grounded at one end. The feeding pin of the PIFA is proximal to the ground pin of the parasitic element. The coupling of the meandering, parasitic element to the main antenna results in two resonances. These two resonances are adjusted to be adjacent to each other in order to realize a broader resonance encompassing the DCS, PCS and UMTS frequency ranges.

32 Claims, 3 Drawing Sheets

LOW PROFILE BUILT-IN MULTI-BAND ANTENNA

RELATED APPLICATIONS

This application is related to U.S. patent application Ser. No. 09/112,366 to Ying, filed Jul. 9, 1998 and entitled "Miniature Printed Spiral Antenna for Mobile Terminals", U.S. patent application Ser. No. 09/112,152 to Ying, filed Jul. 9, 1998 and entitled "Printed Twin Spiral Dual Band Antenna", U.S. patent application No. 09/212,259 to Ying, filed Dec. 16, 1998 and entitled "Printed Multi-Banded Patch Antenna, U.S. patent application Ser. No. 09/387,494 to Ying, filed Sep. 1, 1999 and entitled "Semi Built-In Multi-Band Printed Antenna, and U.S. patent application Ser. No. 09/507,673 to Egorov et al., filed Feb. 22, 2000 and entitled "Small-Size Broad-Band Printed Antenna With Parasitic Element", all of which are incorporated by reference in their entireties herein.

BACKGROUND

The present invention relates generally to radio communication systems and, in particular, to built-in antennas incorporated into portable terminals and having a wide bandwidth to facilitate operation of the portable terminals within different frequency bands.

The cellular telephone industry has made phenomenal strides in commercial operations in the United States as well as the rest of the world. Growth in major metropolitan areas has far exceeded expectations and is rapidly outstripping system capacity. Innovative solutions are required to meet these increasing capacity needs as well as maintain high quality service and avoid rising prices.

Throughout the world, one important step in the advancement of radio communication systems is the change from analog to digital transmission. Equally significant is the choice of an effective digital transmission scheme for implementing the next generation technology, e.g., time division multiple access (TDMA) or code division multiple access (CDMA). Furthermore, it is widely believed that the first generation of Personal Communication Networks (PCNs), employing low cost, pocket-sized, cordless telephones that can be carried comfortably and used to make or receive calls in the home, office, street, car, etc., will be provided by, for example, cellular carriers using the next generation digital cellular system infrastructure.

To provide an acceptable level of equipment compatibility, standards have been created in various regions of the world. For example, analog standards such as AMPS (Advanced Mobile Phone System), NMT (Nordic Mobile Telephone) and ETACS and digital standards such as D-AMPS (e.g., as specified in EIA/TIA-IS-54-B and IS-136) and GSM (Global System for Mobile Communications adopted by ETSI) have been promulgated to standardize design criteria for radio communication systems. Once created, these standards tend to be reused in the same or similar form, to specify additional systems. For example, in addition to the original GSM system, there exists the DCS1800 (specified by ETSI) and PCS1900 (specified by JTC in J-STD-007), both of which are based on GSM. A recent evolution in cellular communication services involves the adoption of additional frequency bands for use in handling mobile communications, e.g., for Personal Communication Services (PCS) services. Taking the U.S. as an example, the Cellular hyperband is assigned two frequency bands (commonly referred to as the A frequency band and the B frequency band) for carrying and controlling communications in the 800 MHZ region. The PCS hyperband, on the other hand, is specified in the United States to include six different frequency bands (A, B, C, D, E and F) in the 1900 MHZ region. Thus, eight frequency bands are now available in any given service area of the U.S. to facilitate communication services. Certain standards have been approved for the PCS hyperband (e.g., PCS1900 (J-STD-007)), while others have been approved for the Cellular hyperband (e.g., D-AMPS (IS-136)). Other frequency bands in which these devices will be operating include GPS (operating in the 1.5 GHz range) and UMTS (operating in the 2.0 GHz range).

Each one of the frequency bands specified for the Cellular and PCS hyperbands is allocated a plurality of traffic channels and at least one access or control channel. The control channel is used to control or supervise the operation of mobile stations by means of information transmitted to and received from the mobile stations. Such information may include incoming call signals, outgoing call signals, page signals, page response signals, location registration signals, voice channel assignments, maintenance instructions, handoff, and cell selection or reselection instructions as a mobile station travels out of the radio coverage of one cell and into the radio coverage of another cell. The control and voice channels may operate using either analog modulation or digital modulation.

The signals transmitted by a base station in the downlink over the traffic and control channels are received by mobile or portable terminals, each of which have at least one antenna. Historically, portable terminals have employed a number of different types of antennas to receive and transmit signals over the air interface. For example, monopole antennas mounted perpendicularly to a conducting surface have been found to provide good radiation characteristics, desirable drive point impedances and relatively simple construction. Monopole antennas can be created in various physical forms. For example, rod or whip antennas have frequently been used in conjunction with portable terminals. For high frequency applications where an antenna's length is to be minimized, another choice is the helical antenna.

In addition, mobile terminal manufacturers encounter a constant demand for smaller and smaller terminals. This demand for miniaturization is combined with desire for additional functionality such as having the ability to use the terminal at different frequency bands and different cellular systems.

It is commercially desirable to offer portable terminals which are capable of operating in widely different frequency bands, e.g., bands located in the 1500 MHZ, 1800 MHZ, 1900 MHZ, 2.0 GHz and 2.45 GHz regions. Accordingly, antennas which provide adequate gain and bandwidth in a plurality of these frequency bands will need to be employed in portable terminals. Several attempts have been made to create such antennas.

Japanese patent no. 6-37531 discloses a helix which contains an inner parasitic metal rod. In this patent, the antenna can be tuned to dual resonant frequencies by adjusting the position of the metal rod. Unfortunately, the bandwidth for this design is too narrow for use in cellular communications.

Dual-band, printed, monopole antennas are known in which dual resonance is achieve by the addition of a parasitic strip in close proximity to a printed monopole antenna. While such an antenna has enough bandwidth for cellular communications, it requires the addition of a parasitic strip. Moteco AB in Sweden has designed a coil matching dual-band whip antenna and coil antenna, in which dual resonance is achieved by adjusting the coil matching component (¼λ for 900 MHZ and ½λ for 1800 MHZ). This antenna has relatively good bandwidth and radiation performances and a length in the order of 40 mm. A non-uniform helical dual-band antenna which is relatively small in size is disclosed in copending, commonly assigned U.S. patent application Ser. No. 08/725,507, entitled "Multiple Band Non-Uniform Helical Antennas."

Conventional built-in antennas currently in use in mobile phones include microstrip antennas and planar inverted-F antennas. Microstrip antennas are small in size and light in weight. The planar inverted-F antenna (PIFA) has already been implemented in a mobile phone handset, as described by K. Qassim, "Inverted-F Antenna for Portable Handsets", IEE Colloqium on Microwave Filters and Antennas for Personal Communication Systems, pp.3/1–3/6, February 1994, London, UK. More recently, Lai et al. have published a description of a meandering inverted-F antenna (WO 96/27219). This antenna has a size which is about 40% of that of the conventional PIFA antenna.

However, as mobile phones become smaller and smaller, both conventional microstrip patch and PIFA antennas are still too large to fit future phone chassis. In copending, commonly assigned U.S. patent application No. 09/112,366, entitled "Miniature Printed Spiral Antenna for Mobile Terminals", a printed spiral built-in antenna with a matching post was proposed. The size of the antenna was reduced to 20–30% of the conventional PIFA antenna, which is less than $1/10^{th}$ of a wavelength, in order to make it suitable for future mobile phones.

In addition to a reduced antenna size, next generation mobile phones will require the capability to tune to more than one frequency band for cellular, wireless local area network, GPS and diversity. In copending, commonly assigned U.S. patent application Ser. No. 09/112,152, entitled "Twin Spiral Dual Band Antenna", a multiple band, built-in antenna was proposed which is suitable for future mobile phones. The built-in antenna comprises two spiral conductor arms which are of different lengths and capable of being tuned to different frequency bands. In this design, the bandwidth of the antenna is smaller because thin strip lines are used as radiators. In order to increase bandwidth of the antenna, a compensation method is used by introducing a resistor loading technique on the matching bridge. While this approach leads to a wider bandwidth, it also results in a loss of gain. This antenna is designed for use in two frequency bands.

In copending, commonly assigned U.S. patent application Ser. No. 09/212,259, entitled "Printed Multi-Banded Patch Antenna", another new type of dual band patch antenna is disclosed. In contrast to the twin spiral dual band antenna which uses thin strip lines as radiators, the multi-band patch antenna uses patches with slot cutting. The patches are used as radiators and facilitate a wider bandwidth. The multi-band patch antenna is also designed for two frequency bands.

FIG. 1 illustrates the geometry of a conventional PIFA antenna 100. The PIFA antenna includes a radiating element 110, a feeding pin 120 for the radiating element, a ground pin 130 for the radiating element and a printer circuit band (PCB) ground 140. The radiating element 110 is suspended above the PCB ground 140 in such a manner that the PCB ground 140 covers the area under the radiating element 110. This type of antenna, however, has a small bandwidth in the order of 100 MHZ. In order to increase the bandwidth for an antenna of this design, the vertical distance between the radiating element and the PCB ground has to be increased (that is, the height at which the radiating element 110 is placed above the PCB 140 is increased). This, however, is an undesirable modification as the height increase makes the antenna unattractive for small communication devices.

An alternative method for obtaining a greater bandwidth is illustrated by the antenna 200 of FIG. 2 which corresponds to the antenna design of U.S. patent application No. 09/507,673 referred to above. The PCB board 240 of the antenna 200 does not cover the entire area under the radiating element 210. This increases the distance between the radiating element 210 and the PCB ground 240. That is, the radiating element 210 extends out from the edge of the PCB 240. While the design of antenna 200 leads to a greater bandwidth than antenna 100 of FIG. 1, it is not adequate for covering the frequency bands corresponding to DCS, PCS and UMTS.

The antennas described above lack adequate bandwidth to cover, for example, all of the DCS, PCS and UMTS frequency bands. Therefore, there exists a need for a lowprofile, built-in antenna which can be incorporated into portable terminals and which allow the portable terminals to communicate within the different frequency bands.

SUMMARY

The present invention overcomes the above-identified deficiencies in the art by providing a low-profile, built-in antenna with a wide bandwidth which enables the antenna to be operable at a plurality of frequency bands corresponding to the DCS, PCS and UMTS frequency ranges.

This is accomplished by a built-in planar inverted F-type antenna (PIFA) having a main radiating element located at a first predetermined height above a substrate within said communication device and tuned to a first frequency range, and a parasitic element located at a second predetermined height above said substrate and tuned to a second frequency range that is different from said first frequency range.

In another exemplary embodiments, the antenna comprises a built-in planar inverted F-type antenna (PIFA) having a main radiating element located at a first predetermined height above a substrate and at a first predetermined distance from an edge of said substrate within said communication device and tuned to a first frequency range, and a parasitic element located at a second predetermined distance from the edge of said substrate and tuned to a second frequency range that is different from said frequency range

BRIEF DESCRIPTION OF THE DRAWINGS

The above objects and features of the present invention will be more apparent from the following description of the preferred embodiments with reference to the accompanying drawings, wherein.

DETAILED DESCRIPTION

In the following description, for purposes of explanation and not limitation, specific details are set forth, such as particular circuit components, antenna elements, techniques, etc. in order to provide a thorough understanding of the present invention. However, it will be apparent to one skilled in the art that the present invention may be practiced in other embodiments that depart from these specific details. In other instances, detailed descriptions of well-known methods and elements are omitted so as not to obscure the description of the present invention.

Figure 1:
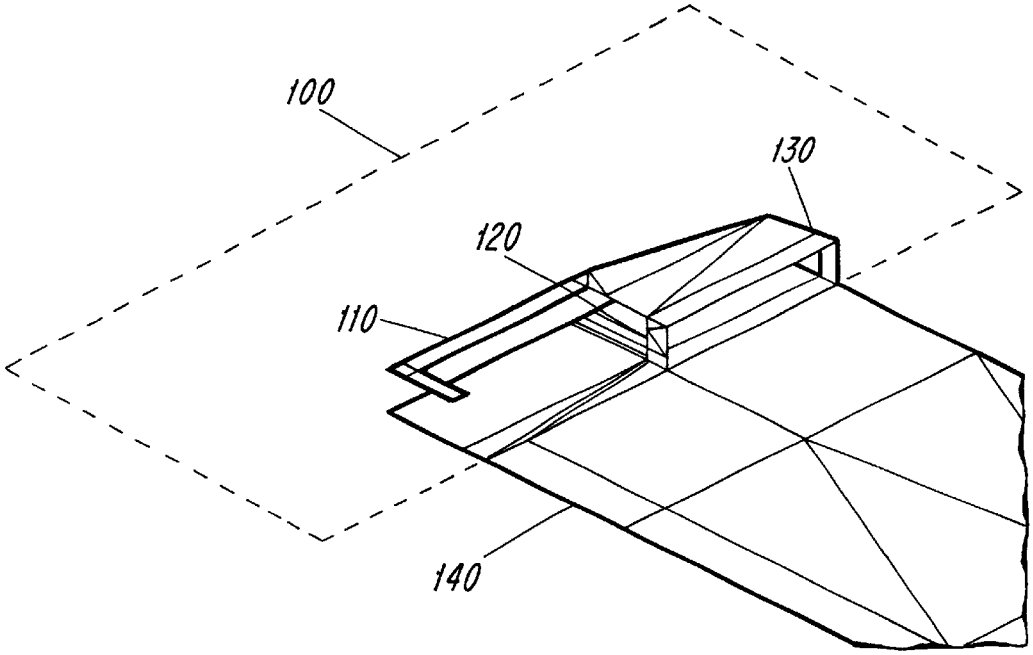
FIG. 1 illustrates a conventional PIFA antenna.
Figure 2:
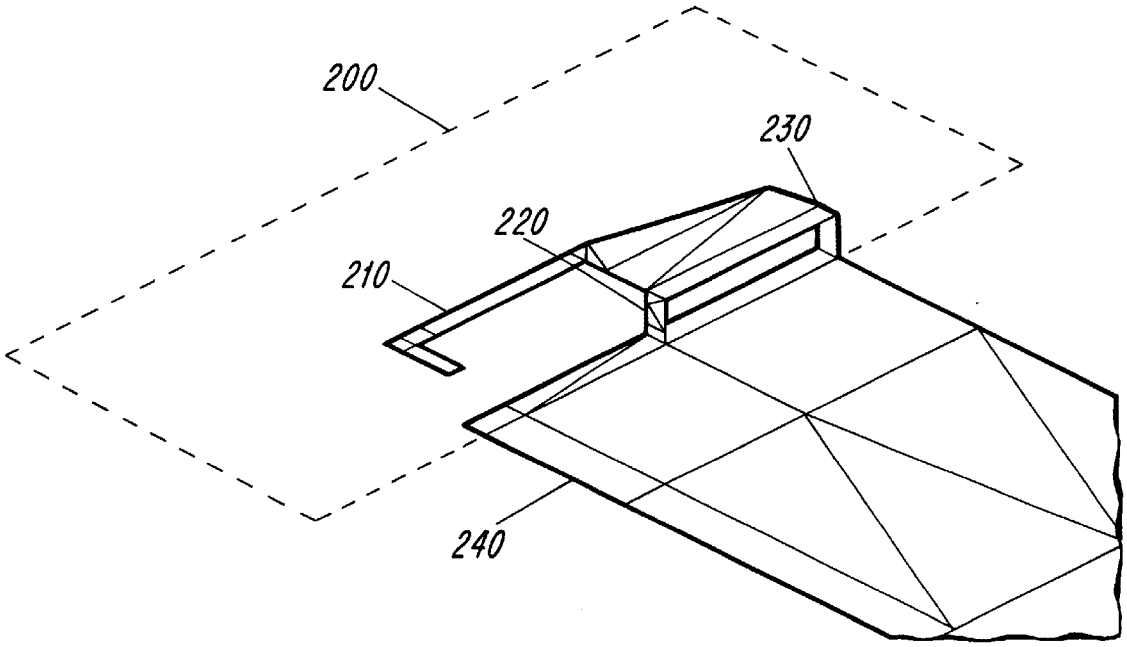
FIG. 2 illustrates a PIFA antenna with the printed circuit board (PCB) ground removed from under the radiating element.
Figure 3:
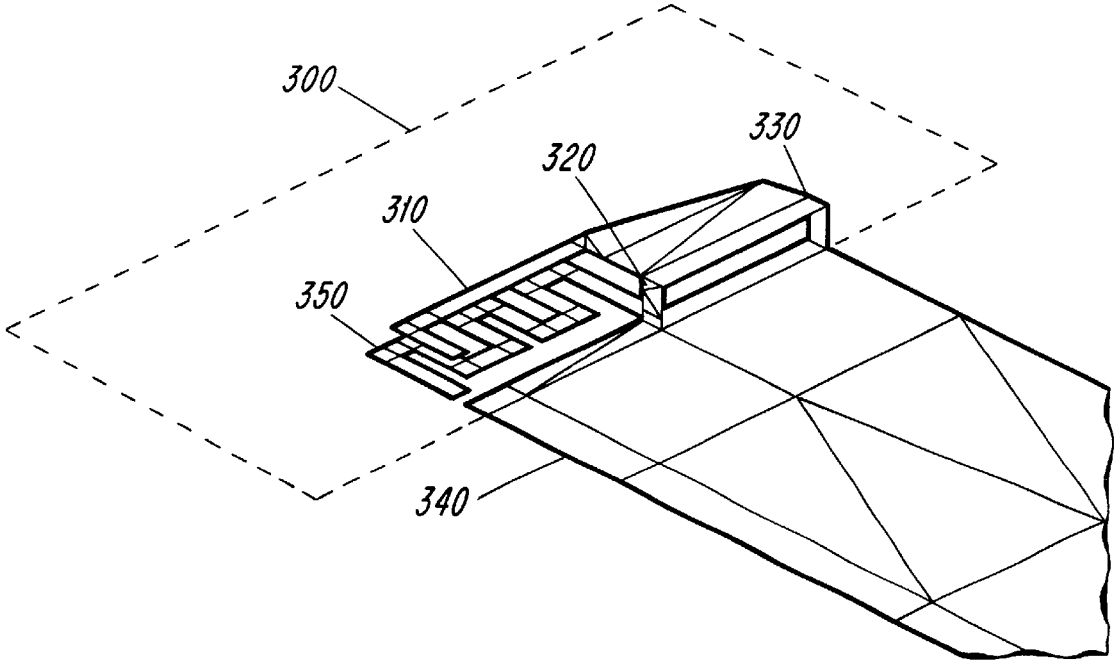
FIG. 3 illustrates a PIFA antenna with a parasitic element according to a first exemplary embodiment of the present invention.

The above mentioned limitations of conventional antennas are overcome by exemplary embodiments of the present invention which provide a greater bandwidth thus facilitating operation of the communication device in the DCS, PCS and UMTS frequency ranges. This embodiment is illustrated in FIG. 3. The dimensions of the antenna 200 of FIG. 2 remain constant. The wider bandwidth is realized by providing a parasitic, meandering radiating element 350 in addition to the main radiating element 310.

According to an exemplary embodiment of the present invention which facilitates an increased bandwidth, the antenna 300 comprises a main radiating element 310 (in the form of a PIFA), a feeding pin 320 for the main radiating element 310, and a ground pin 330 for connecting the main radiating element 310 to the PCB ground 340. The main radiating element 310 (with the feeding pin 320 and ground pin 330) is placed at a predetermined height with respect to the PCB ground 340. The antenna 300 is similar in structure to antenna 200 of FIG. 2. However, an additional element in the form of a meandering, parasitic element 350 is included which is in the same plane as the PCB ground 340; that is, the parasitic element is at the same height as the PCB ground. The parasitic element 350 is connected at one end to the PCB ground 340.

The parasitic element 350 creates an additional resonance. This additional resonance can be adjusted so that it occurs near or adjacent the higher resonance frequency of the main antenna element 310. As a result, the two resonances merge into a broader resonance. According to exemplary embodiments of Applicants' invention, there are additional tuning parameters for the antenna 300 beside the thickness of the antenna substrate, positions of the feeding pin 320 and ground pin 330. These additional parameters are the distance between the PCB ground 340 and main radiating element 310, distance between the main element 310 and parasitic element 350 as well as the length of each of the main element 310 and the parasitic element 350. In particular, to achieve a greater bandwidth, the distance between the feeding pin 320 of the main radiating element 310 and the parasitic element 350 is minimized. This distance may, for example, be approximately 0.5 mm. The radiating element 310 and the parasitic element 350 also have a low-profile in order to enable the placement of the antenna on a circuit board of a cellular telephone, for example.

The bandwidth of antenna 300 of FIG. 3 is limited by the thickness of the antenna substrate. If this thickness (i.e., of the substrate) is increased, the bandwidth of the antenna increases. In the alternative, a parasitic element, such as element 350, can be used to obtain a resonance that is distinct and separate (i.e., not adjacent) from the resonance of the main element if a particular application requires such an arrangement (i.e., two distinct resonances that do not merge into one resonance).

Figure 5:
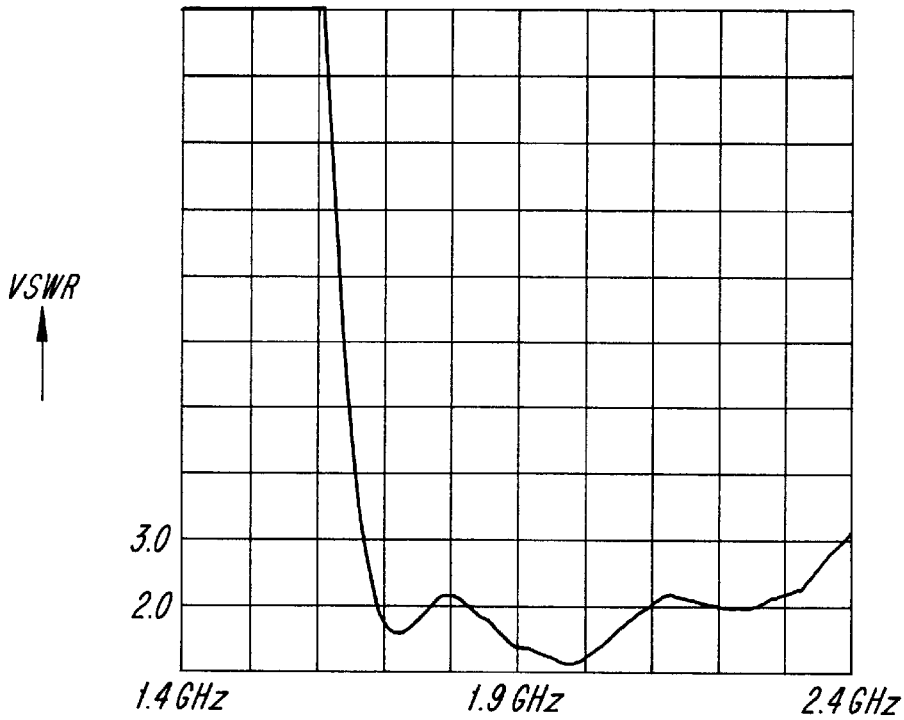
FIG. 5 illustrates the voltage standing wave ratio (VSWR) characteristics for the antenna of FIG. 3.

The dimensions of the antenna 300 are similar to that of antenna 200. The presence of the parasitic element 350 results in a much wider bandwidth. The voltage standing wave ratio (VSWR) for the antenna arrangement of FIG. 3 is illustrated in FIG. 5. As shown, for a VSWR of less than 2.5:1, the bandwidth is approximately 600 MHZ.

VSWR values can range from 1 to infinity and indicate the amount of interference between two waves traveling in opposite direction in a transmission line feeding the antenna ad thus describes the rate of the matching of the antenna to the desired impedance (usually about 50 ohms). One of the waves is the source feeding the antenna while the other is the reflection from the antenna back to the transmission line. The objective in designing an antenna is to minimize this reflection. The maximum VSWR value of infinity occurs when the reflected wave has the same intensity as the incident one. That is, the whole signal is reflected and no power is provided to the radiating element. The minimum VSWR of 1 occurs when the antenna is perfectly matched; that is, no power is reflected. An antenna may operate efficiently when the VSWR value is approximately less than 2.5 at the frequencies of operation.

The position of the feeding pin 320 and ground pin 330 as well as the lengths of the main radiating element 310 and parasitic element 350 are used for matching and tuning the antenna 300. The dimensions of the antenna 300 are approximately 39 mm length, 14 mm width and 4 mm height. The length of the main radiating element 310 is approximately 24 mm and that of the parasitic element 350 is approximately 40 mm. These particular dimensions enable this antenna to be placed in a communication device such as a cellular phone circuit board, for example. The antenna substrate 340 is made of porous material which has a dielectric permitivity ($\in_r$) of 1 and a loss tangent (tan $\delta$) of almost zero. These dimensions yield a bandwidth of over 600 MHZ in the 1600 MHZ to 2200 MHZ frequency range.

Figure 4:
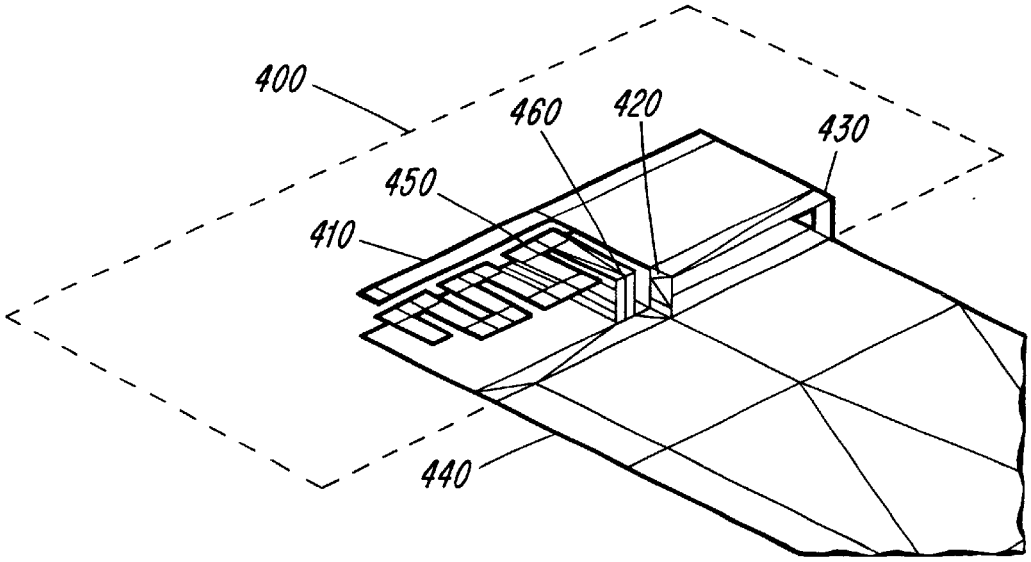
FIG. 4 illustrates a PIFA antenna with a parasitic element according to a second exemplary embodiment of the present invention.

A second exemplary embodiment of the present invention is illustrated in FIG. 4. The antenna 400 is similar in structure to antenna 300 of FIG. 3. However, the parasitic element 450 is not at the same plane as the PCB ground 440. In addition, the PCB ground 440 is below the antenna 400. The length of the main radiating element 410 is approximately 20 mm and that of the parasitic element 450 is approximately 45 mm. While this particular design results in smaller bandwidth than that of antenna 300, the bandwidth realized is much greater than the PIFA antenna 200, for example.

The VSWR of antenna 300 of FIG. 3 according to the dimensions specified above is illustrated in FIG. 5. As shown, for a ratio of less than 2.5:1, the bandwidth is approximately 600 MHZ which is more than adequate for the desired DCS/PCS/UMTS application.

In order to illustrate the effectiveness of the present invention, FIG. 5 sets forth results of a measurement for the exemplary antenna illustrated in FIG. 3. As seen in FIG. 5, for a VSWR of approximately 2.5:1, the bandwidth ranges from approximately 1.675 GHz to 2.34 Ghz resulting in a bandwidth of approximately 650 MHZ. Purely for purposes of illustrating the present invention, the following values for the various parameters enumerated above for an antenna may be used. The substrate may be porous material.

The type of material used for the substrate affects the antenna performance. Therefore, if the substrate material is altered (for example, from porous to some other material), the antenna may have to be re-tuned. If the dielectric constant (i.e., the permitivity constant) of the material is increased, the bandwidth decreases. The present invention, however, is not limited to porous material. Therefore, other materials with reasonable electric parameters will also provide an adequate bandwidth for the antenna of the present invention.

Figure 6:
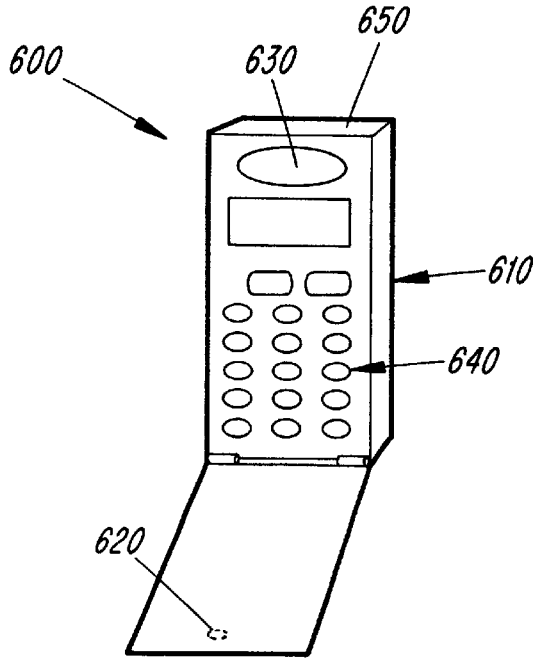
FIG. 6 illustrates an exemplary communication device encompassing an antenna of the present invention.

FIG. 6 illustrates an exemplary communication device, such as a cellular telephone 600 that can operate in any of the DCS, PCS and UMTS frequency ranges. Communication device 600 includes a chassis 610 having a microphone opening 620 and speaker opening 630 located approximately next to the position of the mouth and ear, respectively, of a user. A keypad 640 allows the user to interact with the communication device, e.g., by inputting a telephone number to be dialed. The communication device 600 also includes a PIFA antenna with a meandering, parasitic element 650.

The foregoing has described the principles, preferred embodiments and modes of operation of the present invention. However, the invention should not be construed as being limited to the particular embodiments discussed above. For example, while the antenna of the present invention has been discussed primarily as being a radiator, one skilled in the art will appreciate that the antenna of the present invention would also be used as a sensor for receiving information at specific frequencies. Similarly, the dimensions of the various elements (such as, the substrate) may vary based on the specific application. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. A communication device for use in a short-range, wireless mode, said device comprising:

a receiver for allowing the communication device to receive information from a user;

a transmitter for allowing the communication device to transmit information to said user;

an input means;

a built-in planar inverted F-type antenna (PIFA) having a main radiating element which comprises a ground pin and a feeding pin and is located at a first predetermined height above a substrate within said communication device and tuned to a first frequency range; and a parasitic element located at a second predetermined height in between said substrate and said main radiating element and tuned to a second frequency range that is different from said first frequency range.

2. The communication device of claim 1, wherein said first frequency range is lower than said second frequency range.

3. The communication device of claim 1, wherein said first frequency range is adjacent said second frequency range.

4. The communication device of claim 1, wherein said first and second frequency ranges form a continuous frequency range.

5. The communication device of claim 4, wherein said continuous frequency range includes the 1800 MHZ frequency band corresponding to a DCS frequency band.

6. The communication device of claim 4, wherein said continuous frequency range includes the 1900 MHZ frequency band corresponding to a PCS frequency band.

7. The communication device of claim 4, wherein said continuous frequency range includes the 2 GHz frequency band corresponding to a UMTS frequency band.

8. The communication device of claim 1, wherein said main radiating element has a length that is less than a length of the substrate.

9. The communication device of claim 1, wherein said main radiating element has a width that is less than a width of the substrate.

10. The communication device of claim 1, wherein the parasitic element is located below said main radiating element.

11. The communication device of claim 10, wherein the parasitic element is located at a same height as the main radiating element.

12. The communication device of claim 1 wherein the substrate is made of porous material.

13. A low profile, built-in antenna for a communication device operating in a plurality of frequency bands, said antenna comprising:

a built-in planar inverted F-type antenna (PIFA) having a main radiating element which comprises a ground pin and a feeding pin and is located at a first predetermined height above a substrate within said communication device and tuned to a first frequency range, and a parasitic element located at a second predetermined height in between said substrate and said main radiating element and tuned to a second frequency range that is different from said first frequency range.

14. The antenna of claim 13, wherein the parasitic element is located below said main radiating element.

15. The antenna of claim 13, wherein the parasitic element is located at a same height as said main radiating element.

16. The antenna of claim 13, wherein said first and second frequency ranges form a continuous frequency range including the DCS, PCS and UMTS frequency bands.

17. A communication device for use in a short-range, wireless mode, said device comprising:

a receiver for allowing the communication device to receive information from a user;

a transmitter for allowing the communication device to transmit information to said user;

an input means;

a built-in planar inverted F-type antenna (PIFA) having a main radiating element which comprises a ground pin and a feeding pin and is located at a predetermined height above a substrate and at a first predetermined distance from an edge of said substrate within said communication device and tuned to a first frequency range; and a parasitic element located on the same plane as the substrate and at a second predetermined distance from the edge of said substrate and tuned to a second frequency range that is different from said first frequency range.

18. The communication device of claim 17, wherein said first frequency range is lower than said second frequency range.

19. The communication device of claim 17, wherein said first frequency range is adjacent said second frequency range.

20. The communication device of claim 17, wherein said first and second frequency ranges form a continuous frequency range.

21. The communication device of claim 20, wherein said continuous frequency range includes the 1800 MHZ frequency band corresponding to a DCS frequency band.

22. The communication device of claim 20, wherein said continuous frequency range includes the 1900 MHZ frequency band corresponding to a PCS frequency band.

23. The communication device of claim 20, wherein said continuous frequency range includes the 2 GHz frequency band corresponding to a UMTS frequency band.

24. The communication device of claim 17, wherein said main radiating element has a length that is less than a length of the substrate.

25. The communication device of claim 17, wherein said main radiating element has a width that is less than a width of the substrate.

26. The communication device of claim 17, wherein the parasitic element is located below said main radiating element.

27. The communication device of claim 26, wherein the parasitic element is located at a same height as the substrate.

28. The communication device of claim 26 wherein the substrate is made of porous material.

29. A low profile, built-in antenna for a communication device operating in a plurality of frequency bands, said antenna comprising:

a built-in planar inverted F-type antenna (PIFA) having a main radiating element which comprises a ground pin and a feeding pin and is located at a first predetermined height above a substrate and at a first predetermined distance from an edge of said substrate within said communication device and tuned to a first frequency range, and a parasitic element located on the same plane as the substrate and at a second predetermined distance from the edge of said substrate and tuned to a second frequency range that is different from said first frequency range.

30. The antenna of claim 29, wherein the parasitic element is located below said main radiating element.

31. The antenna of claim 29, wherein the parasitic element is located at a same height as said substrate.

32. The antenna of claim 29, wherein said first and second frequency ranges form a continuous frequency range including the DCS, PCS and UMTS frequency bands.

* * * * *